United States Patent [19]

Guggenberger et al.

[11] Patent Number: 4,739,563

[45] Date of Patent: Apr. 26, 1988

[54] SKI BOOT

[75] Inventors: Hermann Guggenberger, Esslingen; Klaus Walkhoff, Kreuzlingen, both of Switzerland

[73] Assignees: Morgental Gudo AG, Zumikon; Raichle Sportschuh AG, Kreuzlingen, both of Switzerland

[21] Appl. No.: 899,819

[22] Filed: Aug. 25, 1986

[30] Foreign Application Priority Data

Aug. 26, 1985 [CH] Switzerland ..... 3663/85

[51] Int. Cl.[4] ..... A43B 504; A43C 11/00

[52] U.S. Cl. ..... 36/117; 36/50; 36/119

[58] Field of Search ..... 36/117–121, 36/50, 93; 24/688 X

[56] References Cited

U.S. PATENT DOCUMENTS

| | | | |
|---|---|---|---|
| 3,534,391 | 10/1970 | Bauer | 36/117 X |
| 3,686,778 | 8/1972 | Hornung | 36/120 |
| 4,449,273 | 5/1984 | Baggio | 36/117 X |
| 4,539,763 | 9/1985 | Walkhoff | 36/120 |
| 4,583,305 | 4/1986 | Miyamoto | 36/119 |
| 4,640,026 | 2/1987 | Kirsch | 36/117 |
| 4,644,671 | 2/1987 | Walkhoff | 36/119 |

FOREIGN PATENT DOCUMENTS

| | | | |
|---|---|---|---|
| 2456612 | 6/1975 | Fed. Rep. of Germany | 36/119 |
| 3247516 | 6/1984 | Fed. Rep. of Germany | 36/117 |
| 3506057 | 2/1986 | Fed. Rep. of Germany | 36/117 |

*Primary Examiner*—James Kee Chi

*Attorney, Agent, or Firm*—Collard, Roe & Galgano

[57] ABSTRACT

A ski boot is provided having a clamping device mounted on the rear heel part for tightening and loosening a mechanical coupling arrangement connected to a restraining part arranged on the ski boot. The clamping device may be a hydraulic, pneumatic or electric driving system with an adjusting element for acting on the mechanical coupling arrangement. At least one actuating element is mounted on the top side of the clamping device, which can be depressed with the help of a ski pole so as to permit clamping of the retaining part with the desired tightness.

25 Claims, 10 Drawing Sheets

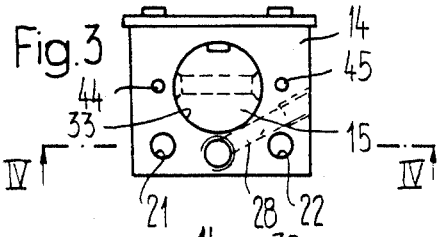
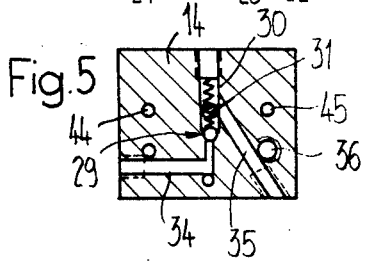
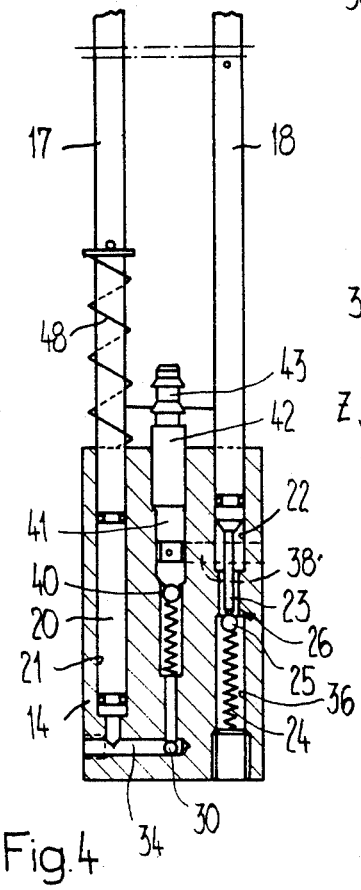
Fig.4
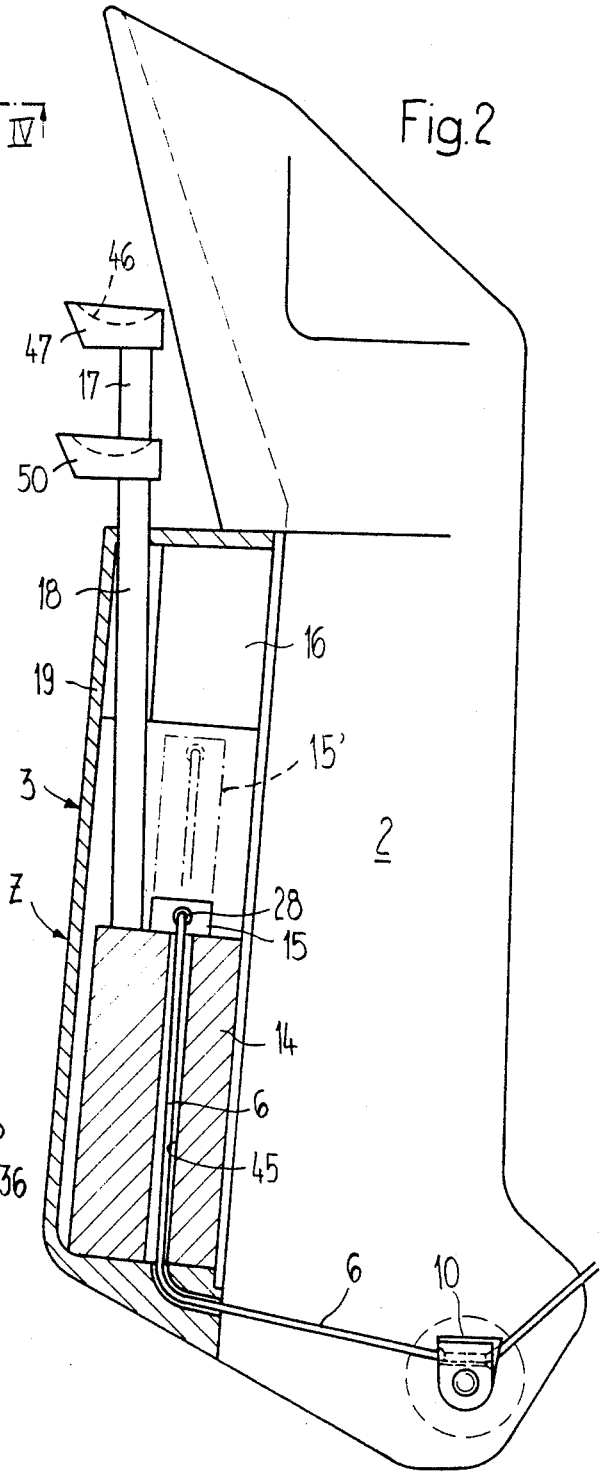

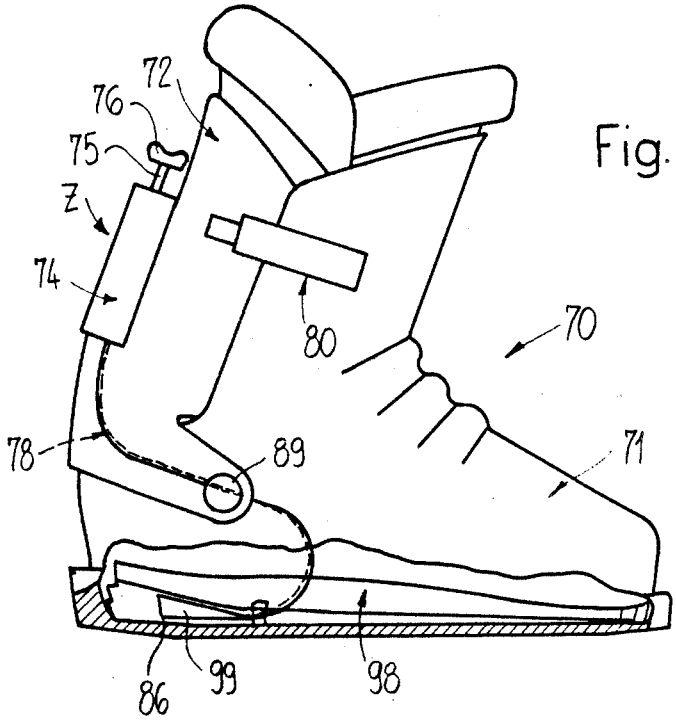
Fig. 18
Fig. 19
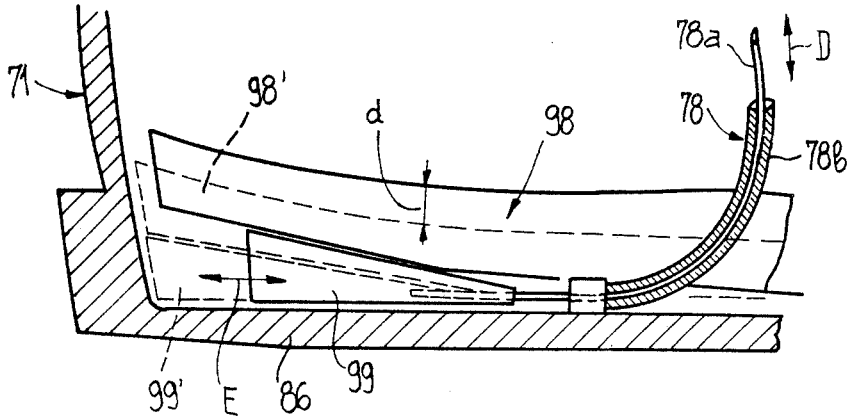

SKI BOOT

The present invention relates generally to a ski boot and, more particularly, to a ski boot having an adjusting means for adjusting the boot with respect to the skier's foot operated by an operating device.

A known ski boot of this type is described in U.S. Pat. No. 4,449,273, to Baggio, granted May 22, 1984 and has a manually operated hydraulic pump, which is connected with a number of individual clamping units through a pressure distribution arrangement. The clamping units include a clamping piston guided in a cylinder wherein the rod of the piston is coupled with an element on the ski boot, for example a part of a locking buckle, that is to be manipulated. The pump and the clamping units are arranged locally separated from each other and connected with each other by means of hydraulic lines, which must be run in or through the ski boot. Apart from having a complicated design, the drawback of this solution is that the many different hydraulic lines pose the hazard of extremely undesirable leakage.

The object of the present invention is to provide a ski boot of the type described above that is simpler in terms of design and easier to maintain than the known ski boot and which, furthermore, can be manufactured at low cost.

By providing a ski boot with a central driving unit connected with the part of parts of the boot to be manipulated through a mechanical coupling arrangement, a simple construction is obtained, which is easy to maintain, has a relatively simple structure and which can be manufactured at low cost. In a hydraulic control mechanism utilized in the central driving unit, the pressure medium is present only in the central driving unit, which is accessible from outside the ski boot, so that leakage can be prevented by suitable measures. Nevertheless, should leakage of the pressure medium occur, it is relatively easy to find the cause and repair the damage.

Preferably, the mechanical coupling arrangement is formed by at least one oblong, flexible connection element, which preferably is a connection cable or the like. In particular Bowden wires are suitable in many applications.

In the hydraulic control mechanism, the central driving unit has a pump, a reservoir for the hydraulic medium connected with the pump, as well as the adjusting element whose position can be changed by manipulating the pump. The latter is manipulated by means of an element that is operated by hand or with a ski pole.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views:

FIG. 2 is a vertical cross-sectional view through the clamping device according to FIG. 1, with a lateral view of the rear shaft portion of a ski boot;

FIG. 3 is a top view of the hydraulic block of the clamping unit according to FIGS. 1 and 2;

FIG. 4 is a vertical cross-sectional view through the hydraulic block taken along line IV—IV of FIG. 3;

FIG. 5 is a cross-sectional view of the hydraulic block taken along line V—V of FIG. 1;

FIG. 18 is a side elevational view of a ski boot embodying the clamping device of the present invention for adjusting the heel of the foot bed in the boot;

FIG. 19 is a detailed enlarged view similar to FIG. 18;

Figure 6:
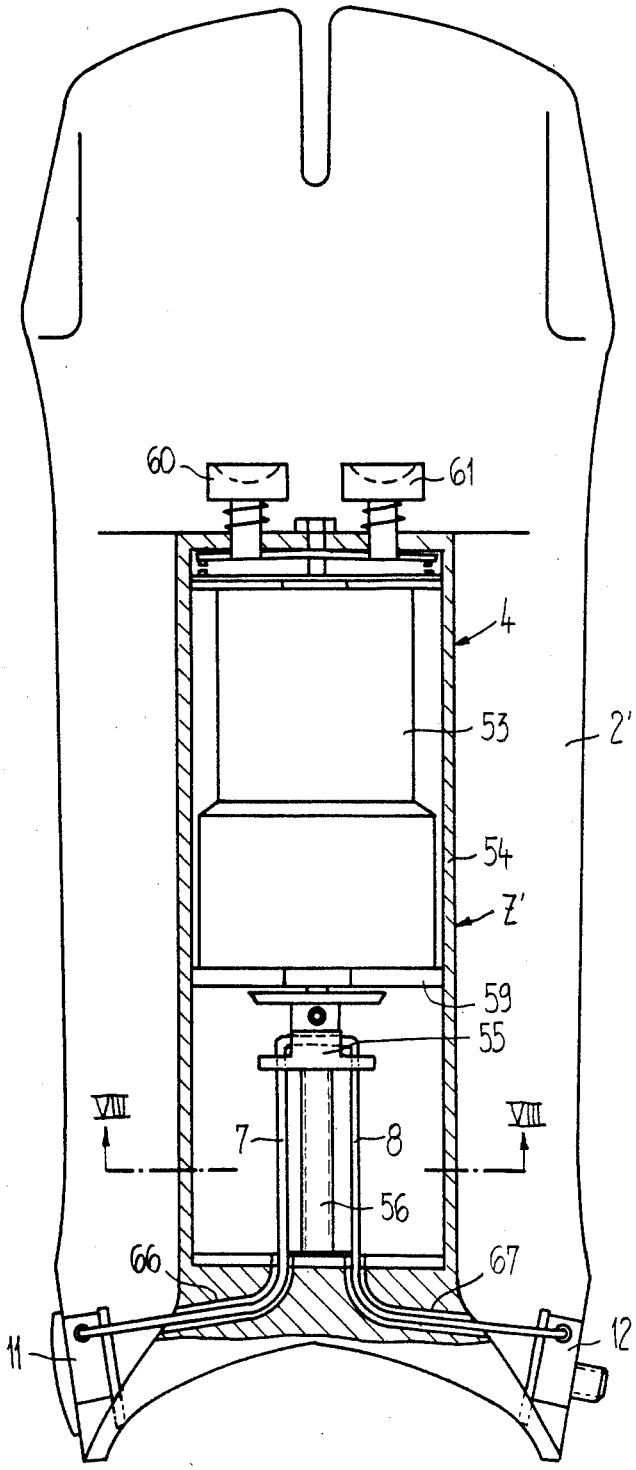
FIG. 6 is a vertical cross-sectional view similar to that of FIG. 1 wherein the clamping device is an electric motor type.
Figure 8:
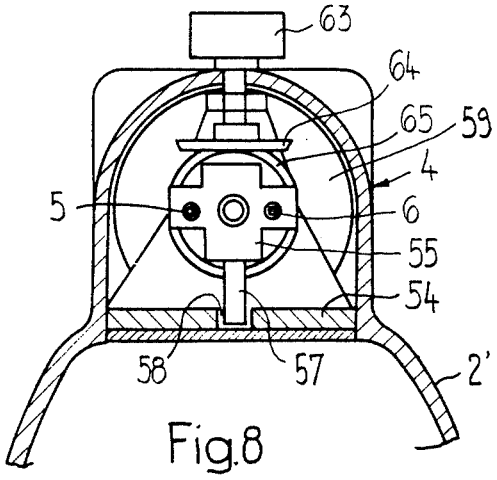
FIG. 8 is a cross-sectional view of the clamping unit of FIG. 6 taken along the line VIII—VIII of FIG. 6, showing an adjoining part of the ski boot.
Figure 7:
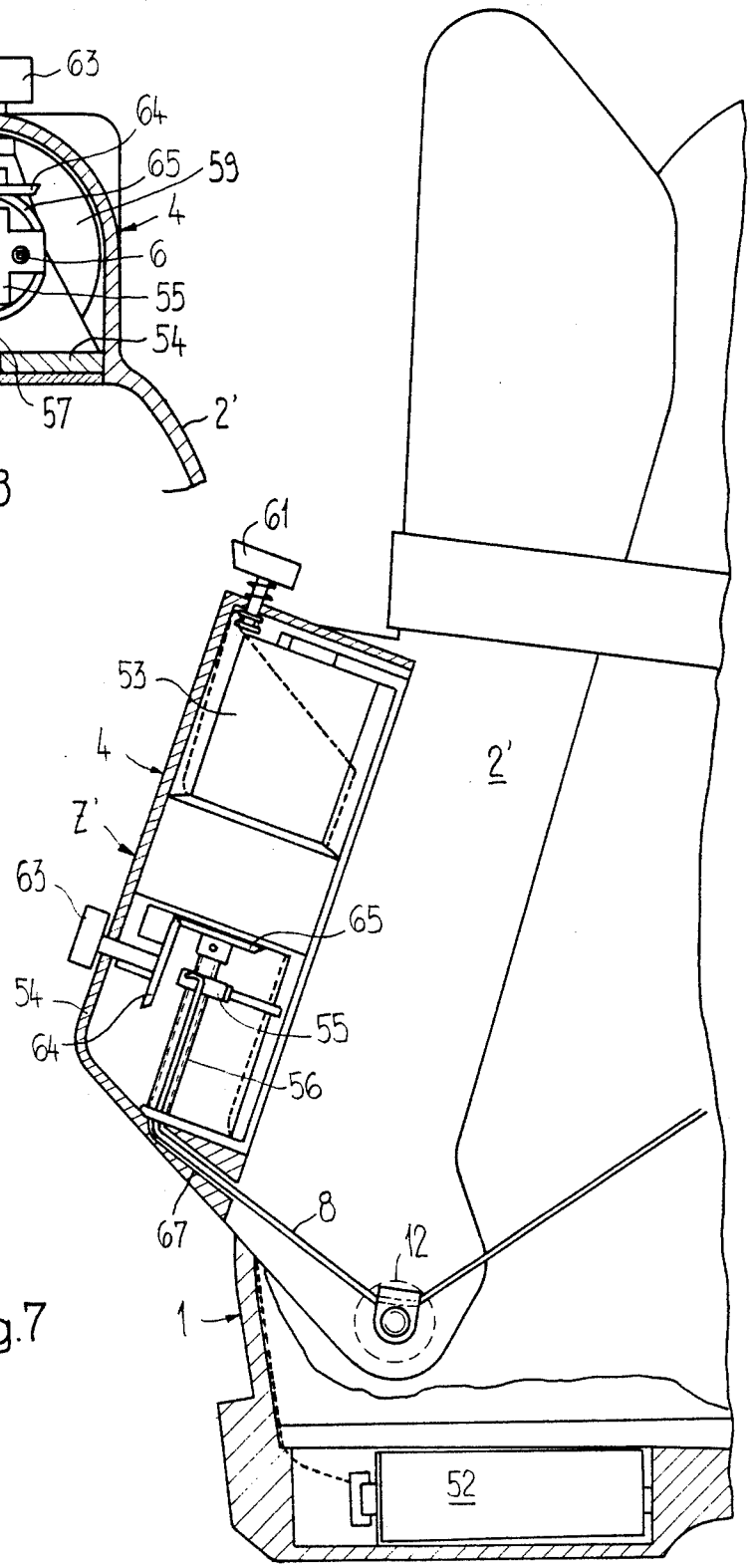
FIG. 7 is a vertical cross-sectional view similar to FIG. 2 of the clamping unit according to FIG. 6 with a partly sectional lateral view of the rear part of a ski boot.

The embodiments of a ski boot 1 (see FIG. 7) according to the present invention as shown in FIGS. 1 to 8 have one common feature, which is a clamping device 3 (FIGS. 1 to 5) or 4 (FIGS. 6 to 8) mounted on a rear shaft portion 2 (FIGS. 1 to 5) or 2' (FIGS. 6 to 8), which is pivotally mounted on ski boot 1. As it is known per se from U.S. Pat. No. 4,539,763, and from U.S. application Ser. No. 715,684, filed Mar. 25, 1985, one set of cables 5 and 6 (FIGS. 1 to 5), or 7 and 8 (FIGS. 6 to 8), runs on each side of boot 1 via pivots 9, 10, and 11, 12, respectively, of the rear shaft part 2 and 2', extending into the retaining part mounted within the front zone of ski boot 1, which part, however, is not described in detail in said reference. The function of clamping device 3 or 4 is to control or regulate the contact pressure of such retaining part on the instep of the boot by tightening or loosening the sets of cables, so that the foot is optimally supported in the ski boot with respect to comfort and controllability of the ski. The embodiments according to FIGS. 1 to 5 are provided with a hydraulic driving system, whereas the embodiment according to FIGS. 6 to 8 is provided with an electric motor driving system.

First, clamping unit 3 with a central hydraulic driving unit Z will be described in detail. This embodiment substantially consists of a hydraulic block 14 enclosing a clamping piston 15, a reservoir 16 for the hydraulic medium and two operating rods 17 and 18, all of which are enclosed by a common casing 19 of the driving unit. This casing 19 is molded or secured on the rear shaft portion 2 of the ski boot. As clearly seen in FIG. 4, operating rod 17, which projects upwardly from the casing 19, has a bottom end forming a pump plunger 20 guided in a cylinder bore 21 of hydraulic block 14. The second, shorter operating rod 18 is guided in a bore 22 of cylinder block 14 and has a tappet 23 at its bottom end. When the relief valve 26—which is part of driving unit 2—is to be opened in order to loosen the tension of the cable sets 5 and 6, such tappet presses against a valve body 25 that is loaded by spring 24. Both sets of cables are run in a loop through a top transverse bore 28 of clamping piston 15 (see FIG. 2), so that the cable sets 5 and 6 are tightened by an upward motion of clamping piston 15, as shown in phantom in FIGS. 1 and 2.

As clearly seen in FIG. 5, a pump pressure valve 29 is disposed in a horizontally extending bore 30 in the lower part of hydraulic block 14, from where a short vertical bore 31 (see FIGS. 1 and 5) extends or leads to clamping cylinder 33, which receives clamping piston 15, of hydraulic block 14. Viewed in the direction of flow, such short bore is disposed behind the pump pressure valve. Another horizontally extending bore 34 is the pump pressure line which connects cylinder bore 21 and bore 30 and thus bore 21 and pump pressure valve 29. In the direction of flow behind the pump pressure valve 29, a third bore 35 branches off and extends horizontally with an inclination to establish the connection with a relief line 36 receiving relief valve 26, such relief line being formed by another vertical bore. Behind relief valve 26, which is operated by tappet 23, a short transverse bore 38 (shown in FIG. 4 in phantom) establishes the connection with pump suction line 41 receiving pump valve 40. A nipple body 42 is inserted in suction line 41, and nipple part 43, which projects upwardly from hydraulic block 14, establishes the connection with reservoir 16 for the hydraulic medium, which is mounted thereabove. Preferably, the walls of reservoir 16 are made of a material with the elasticity of rubber, so that reservoir 16 does not require venting.

For the purpose of tightening or clamping the two cable sets 5 and 6, which are run through vertical bores 44 and 45, respectively, of hydraulic block 14, the end of a ski pole is inserted in the pan-shaped depression 46 provided on operating key 47 of longer operating rod 17 and pressed down several times against the pressure of coil spring 48 (see FIG. 4) surrounding operating rod 17 until cable sets 5 and 6 have the desired tension, which is felt by the pressure of the retaining part on the instep of the foot. When pump piston 20 is driven up by the force of spring 48, hydraulic medium, for example a hydraulic oil, is sucked in from reservoir 16 via suction line 41 and suction valve 40, which is in the form of a check valve. Subsequently, the downward motion of operating rod 17, which is effected with the ski pole or by hand, forces the hydraulic medium into clamping cylinder 33 under the pressure of pump piston 20 via pump pressure valve 29, which is also a check valve, so that clamping piston 15 is forced up to tighten cable sets 5 and 6.

If cable sets 5 and 6 are too tight or if the tension has to be cancelled in order to remove the ski boot from the foot, the second operating rod 18 acting on relief valve 26 is pressed down by means of the ski pole, which is placed on operating key 50 of rod 18, so that the pressure is relieved in the direction of suction line 41 and thus to reservoir 16. The degree of relief can be controlled by pressing the operating rod 18 down for a shorter or longer period.

Figure 1:
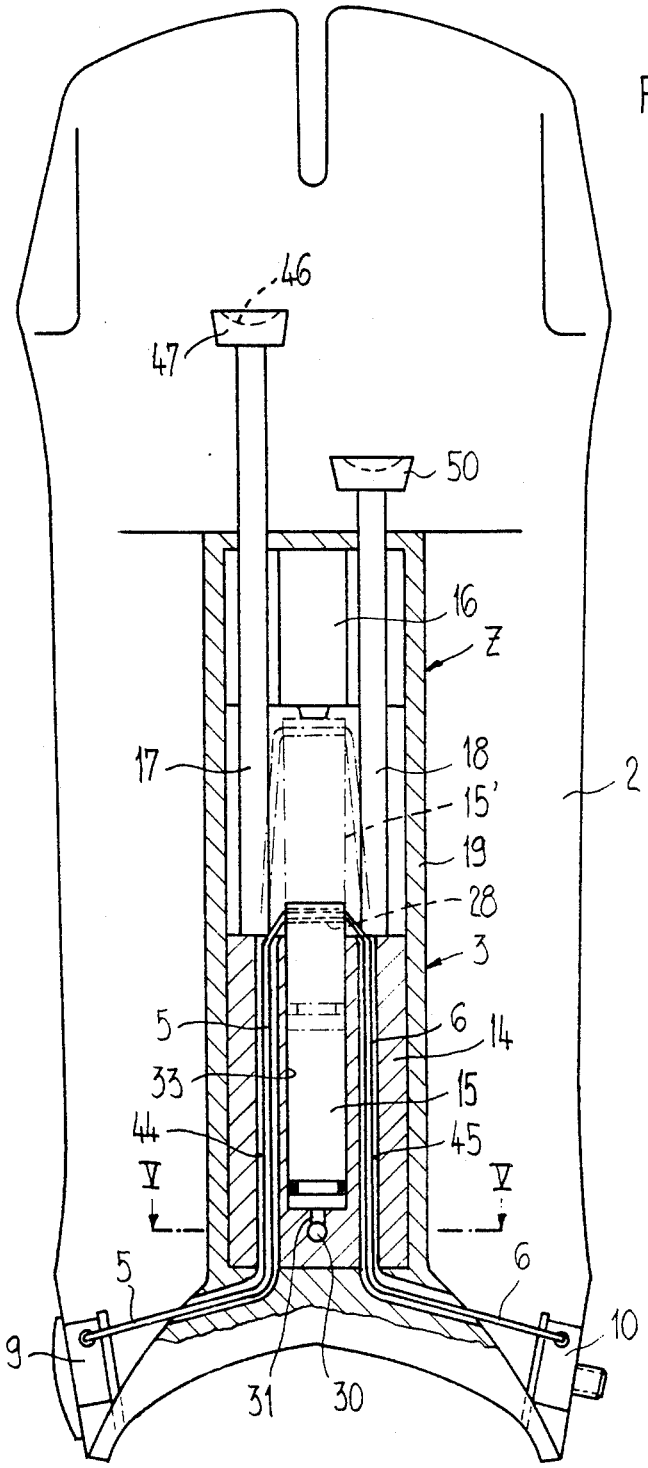
FIG. 1 is a vertical cross-sectional view through a hydraulic clamping device according to the present invention viewing the back of the rear shaft portion of a ski boot.

FIGS. 1 and 2 show the clamping piston 15 in its bottom or lower position in which no tensile stress is applied to the cable sets. The top position 15′ is indicated by phantom lines in FIGS. 1 and 2.

In the embodiment according to FIGS. 6 to 8, a battery 52, which may be arranged in the sole of the boot, with a geared motor 53 serves as the drive. The geared motor and a clamping mechanism act on cable sets 7 and 8. The mechanism and the motor both are part of the central driving unit Z′ and are enclosed in a casing 54, which is molded or secured on the rear shaft portion 2′ of ski boot 1. As in the embodiment described above, cable sets 7 and 8 form a one-piece loop, which is run via clamping element 55 having an inside thread engaging a threaded spindle 56 that is driven by geared motor 53. For the purpose of tightening or loosening cable sets 7 and 8, clamping element 55 is moved up or down in accordance with the sense of rotation of geared motor 53 and threaded spindle 56. As clearly seen in FIG. 8, a pin 57 projecting from the clamping element 55 engages a vertically extending groove 58 of casing 54 and prevents clamping element 55 from rotating together with threaded spindle 56. The tensile force acting on threaded spindle 56 and geared motor 53 when cable sets 7 and 8 are tightened is absorbed by the intermediate wall 59 of casing 54. The sense of rotation of electric geared motor 53 is determined by depressing one of the two keys 60 or 61, in order to tighten or loosen the cables, whereby the geared motor remains switched on only while one of the keys 60 or 61 is depressed.

A bevel gearing with bevel gears 64 and 65, which is drivable by hand via a rotary knob 63, permits additional tightening or loosening by hand, for example if battery 52 is dead. Normally, however, tightening or loosening is accomplished in a particularly simple way by simply depressing keys 60 or 61, for example with the help of the ski pole.

In this embodiment, also, cable sets 7 and 8 are run through reversing ducts 66 and 67, respectively, in the lower part of casing 54 and via pivot pins 11 and 12, of rear shaft portion 2′, and to the front into a retaining part (not shown), in the same way as explained for the embodiment according to FIGS. 1 to 5.

A few of the many feasible embodiments are explained in what follows with reference to FIGS. 9 to 21. As with the embodiments according to FIGS. 1 to 8, these embodiments permit the adjustment of different types of parts of ski boots by means of a central driving unit via sets of cables or a push rod.

In the embodiments according to FIGS. 9 to 21, the central driving unit Z is a hydraulic clamping or control system as shown in the embodiment according to FIGS. 1 to 5. The structure and mode of operation of such driving unit Z are basically the same as the one shown in FIGS. 1 to 5 except that it is equipped with only one single operating rod for the tightening or loosening operation. For this reason, there are certain differences in design as compared to the driving unit Z shown in FIGS. 1 to 5, however, such differences are easily recognized by the expert.

In FIGS. 9 to 21, identical parts are denoted by the same reference numerals.

The ski boot 70 in FIGS. 9 to 21 has a shell part 71 on which a rear shaft part 72 is pivotally mounted. In the embodiments of FIGS. 11 to 15, a tongue part 73 is connected with shell part 71. A hydraulic clamping or operating device 74 forming a central driving unit Z is mounted on the rear shaft part 72. As mentioned before, this driving unit conforms to the clamping device 3 according to FIGS. 1 to 5 in terms of design and mode of operation. However, contrary to the device 3, it has only one operating rod 75, which is provided with an operating key 76 at its top end, such key having a pan-like depression.

Figure 9:
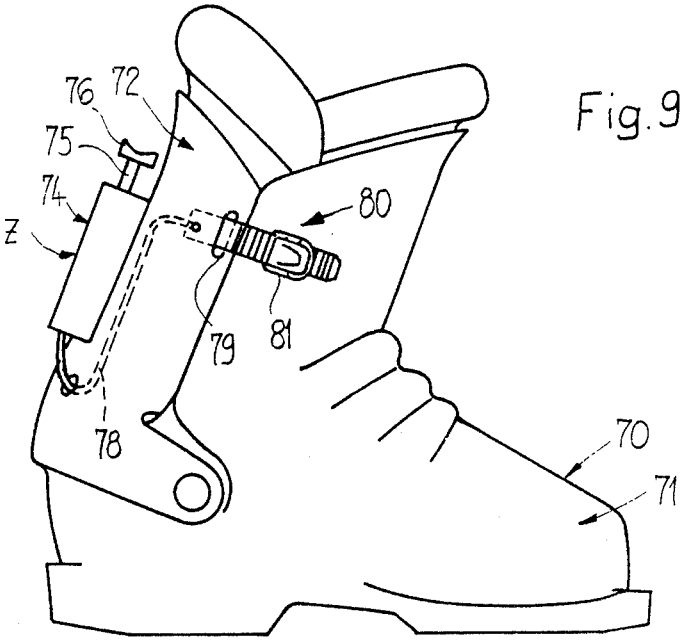
FIG. 9 is a side elevational view of a ski boot embodying the clamping device of the present invention for operating the ski boot closing buckle.
Figure 10:
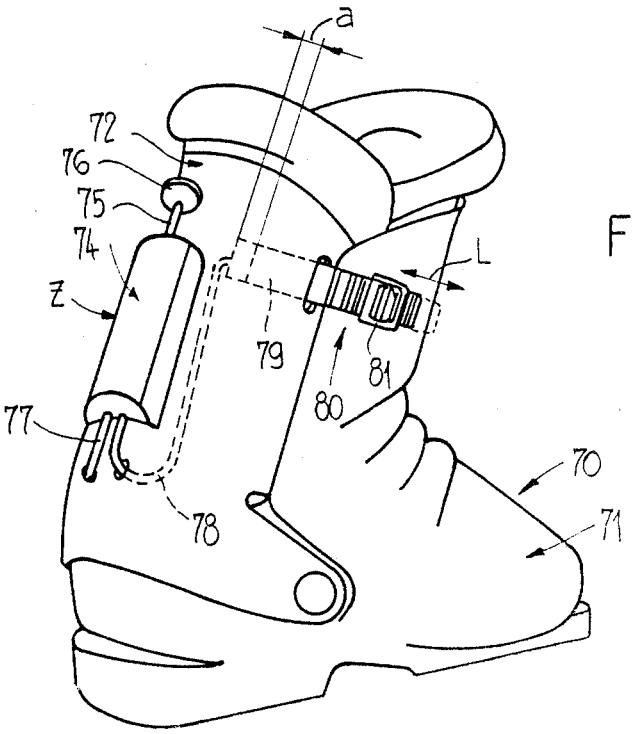
FIG. 10 is a rear and side elevational view of the ski boot of FIG. 9.

In the embodiments shown in FIGS. 9 and 10, two sets of cables 77 and 78 in the form of Bowden wires are connected to the adjusting element shown in phantom, which is accommodated in the interior of the driving unit Z. With their other ends, such cables engage a cogged belt 79, shown partly in phantom, of a locking buckle 80. FIGS. 9 and 10 show only one of the two oppositely arranged locking buckles 80. The latter, furthermore, have a pawl 81 secured on shell part 78. This pawl engages between the teeth of the associated cogged belt 79 and can be released by hand.

By means of clamping device 74, which is operated by depressing operating rod 75, cogged belts 79 are driven via cable sets 77 and 78 in their longitudinal direction L, which causes rear shaft part 72 and the top part of shell 71 to be pulled together. For loosening purposes, pressure is applied again to the operating rod 75. In this manner, the shaft of ski boot 70 can be easily contracted and expanded by operating clamping device 74. In FIG. 10, "a" denotes the path of displacement of cogged belt 79.

Figure 11:
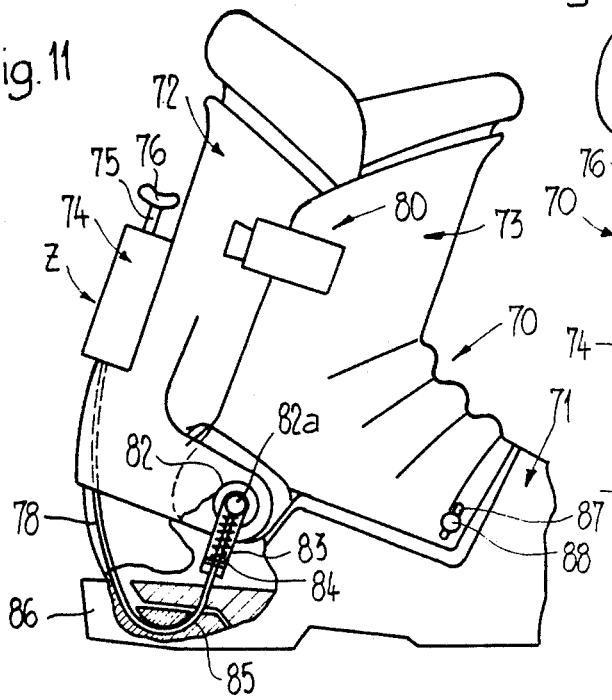
FIG. 11 is a side elevational view partly in section of a ski boot embodying the clamping device of the present invention for a cent adjustment of the boot.
Figure 13:
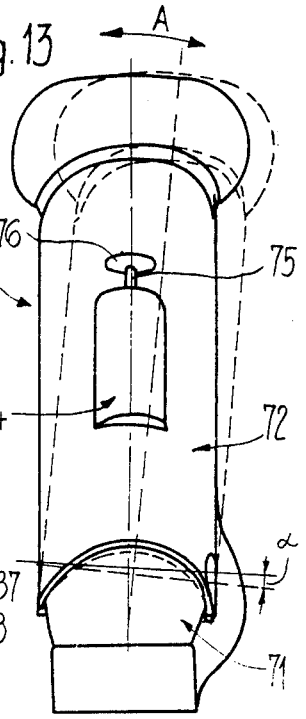
FIG. 13 is a back side view of the ski boot of FIG. 11.
Figure 12:
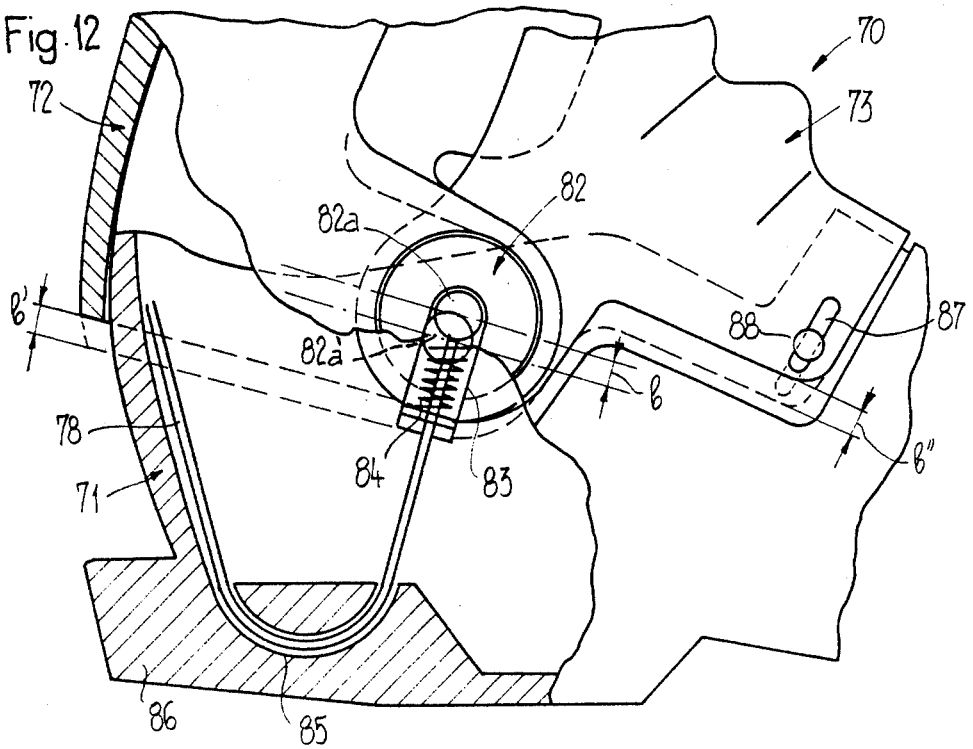
FIG. 12 is an enlarged view similar to that of FIG. 11 showing the adjustment in detail.

With the ski boot shown in FIGS. 11 to 13, the rear shaft part 72 is pivotally connected with shell part 71 by means of a pivot pin 82. Pin 82 has a connecting bolt 82*a*, which penetrates not only rear shaft part 72 but tongue part 73 as well. A corresponding joint is provided on the opposite side of ski boot 1. Now, the set of cables 78 (Bowden wires) connected with hydraulic clamping device 74 engages connecting bolt 82*a* of only one joint, which, in the present case, is the joint disposed on the inside of ski boot 70. Connecting bolt 82*a* is guided in a longitudinal slot 83 in shell part 71 and is supported on pressure spring 84. Cable set 78 is run and reversed through a guide duct 85 in heel 86 of ski boot 70. Tongue part 73 is provided with longitudinal slots 87 through which a bolt 88 secured on shell part 71 projects.

When connecting bolt 82*a* is pulled downwardly by the distance "b", as seen in FIG. 12, against the force of pressure spring 74 by operating clamping device 74, the pivot pin 82 is moved downwardly by the distance "b'", and tongue part 73 is moved by the distance "b'". This movement of pin 82 causes the shaft of ski boot 70 to swivel in a direction A extending transversely to the longitudinal plane of the boot. FIG. 13 shows that this places the shaft of the boot in an inclined position, that is, inclined by the angle $\alpha$. In this way, the shaft of the boot can be adapted to the anatomical features of the skier by means of a so-called canting adjustment.

Figure 14:
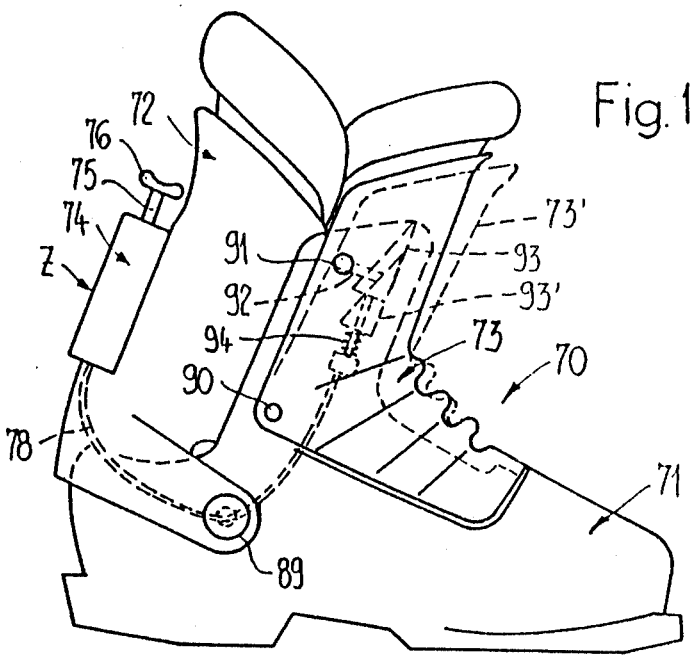
FIG. 14 is a side elevational view of a ski boot embodying the clamping device of the present invention for adjusting the flexure of the tongue of the boot.
Figure 15:
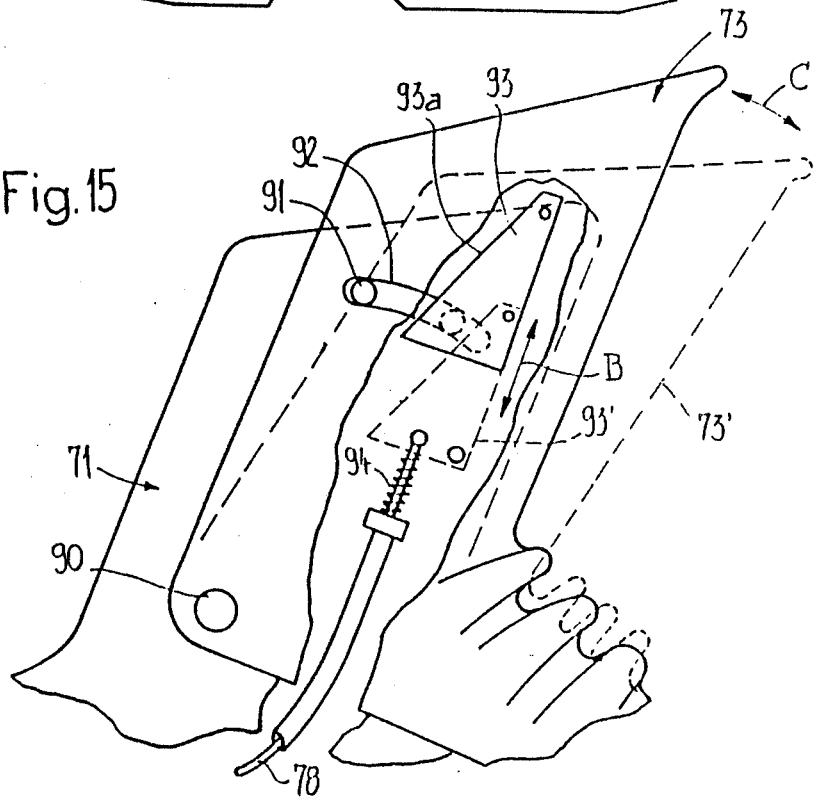
FIG. 15 is a detailed enlarged view, partly broken away, of FIG. 14 showing the adjustment.

With the embodiment according to FIGS. 14 and 15, the forward movement of the shaft 72 of the ski boot 70 about pivot pin 89 can be limited in the longitudinal direction of the boot. For this purpose, tongue part 73, which is connected with shell part 71 in two oppositely arranged locations 90, is provided with two bolts 91, which are also oppositely arranged, and each of which engages a guide slot 92 provided on shell part 71. Bolts 91 cooperate with a limiting wedge 93, which is moved up and down in the direction of arrow B, as seen in FIG. 15, between wedge 93 in solid line and wedge 93' in phantom. On the side facing bolt 91, wedge 93 has a bevelled surface 93*a*, which is inclined relative to the direction of movement B. When tongue part 73 moves in the direction of arrow C, bolt 91 contacts bevelled surface 93*a* and prevents any further forward movement of tongue part 73. For moving wedge 93 in the direction of arrow B, it is connected with the cable set 78 (Bowden wires), which is connected with the adjusting element of central driving unit Z. Wedge 93 is supported on a pressure spring 94.

It can be readily seen from FIG. 15 that bolt 91 and thus tongue part 73 is capable of travelling a greater or lesser distance depending on the position of wedge 93. This system thus limits the flexibility of tongue part 73 and thus the amount of forward pressure which can be applied by the skier.

Figure 16:
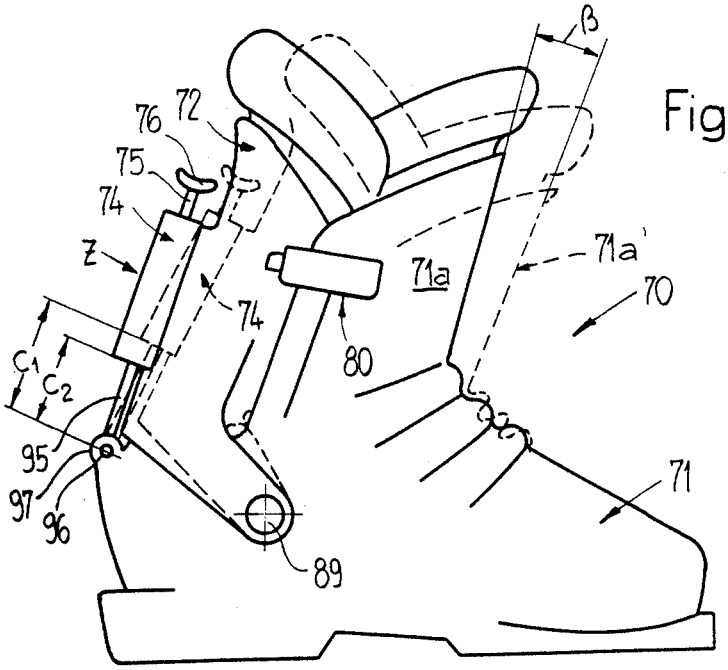
FIG. 16 is a side elevational view of a ski boot embodying the clamping device of the present invention for adjusting the forward lean of the ski boot.
Figure 17:
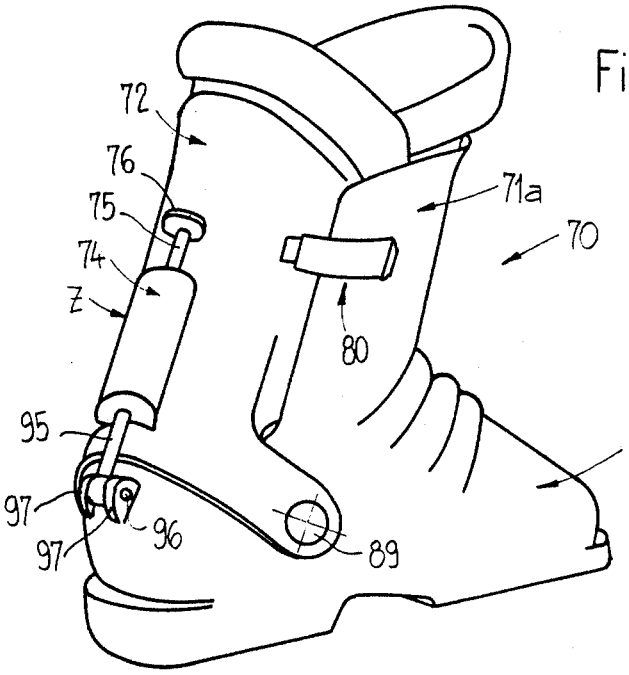
FIG. 17 is a rear and side elevational view of the ski boot of FIG. 16.

The ski boot shown in FIGS. 16 and 17 is different from the other embodiments in that the transmission of motion of the adjusting element of central driving unit Z takes place not by means of sets of cables, but by means of a push rod 95. At its free end, the latter is seated on a bolt 96, which is supported on two lashings 97 molded on shell part 71. When operating device 74 is actuated, push rod 95 is driven out with the result that rear shaft part 72 and thus the whole boot shaft 71*a* is tilted forwardly about pivot pin 89 in the longitudinal direction of the boot, which, in FIG. 16, is shown by the angle $\beta$. The length of the projecting part of the push rod 95 in the two positions is denoted by $c_1$ and $c_2$.

The embodiment according to FIGS. 16 and 17 is different from the other ski boots shown in that the rear shaft part 72 is moved with the operating device 74, and not a part that is separated from the rear shaft part 72. This system has the effect of adjusting the forward lean of the skier in the ski boot.

The ski boot shown in FIGS. 18 and 19 is provided with a foot bed 98 that is adjustable in height and inclination. Within the zone of the heel of ski boot 70, a wedge-like support 99 is arranged beneath foot bed 98. This support 99 is connected with a cable set 78 in the form of Bowden wires. As clearly seen in FIG. 19, when cable 78*a*, which is run in a metallic tube 78*b*, is moved in the direction of arrow D, wedge-type support 99 is moved in the longitudinal direction of the boot, that is, in the direction of arrow E to the position 99' shown in phantom, which rasies or lowers foot bed 98 within the zone of the heel 86 by the amount to the position 98 shown in phantom "d". Rear shaft part 22 is pivotally connected to shell part 21 by means of pivot-pin 89.

Figure 20:
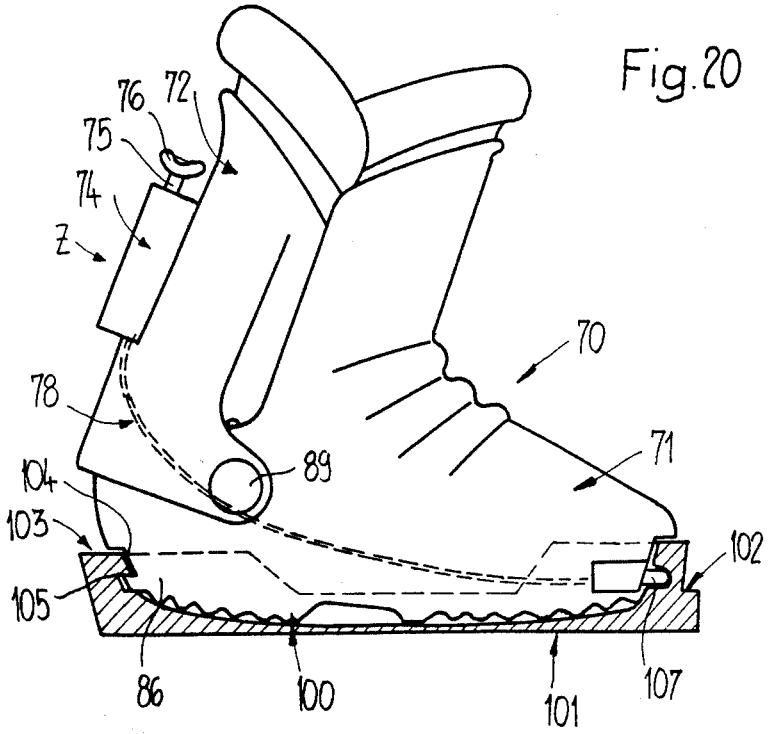
FIG. 20 is a side elevational view of a ski boot embodying the clamping device of the present invention for securing the ski boot to a plate for a ski binding.
Figure 21:
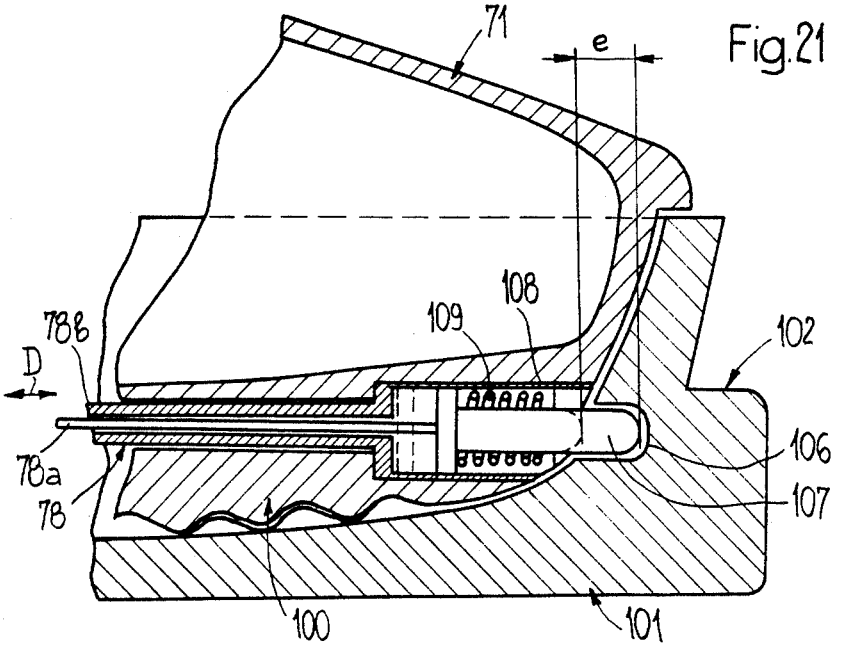
FIG. 21 is a detailed enlarged view similar to FIG. 20.

The ski boot according to FIGS. 20 and 21 is provided with a highly profiled sole 100 that is curved in the direction in which the foot runs off, which facilitates walking. On the underside of sole 100, a sole plate 101 is arranged, which is provided with the surfaces 102 and 103 for receiving ski binding gear. This sole plate 101 is detachably connected with ski boot 70. For this purpose, the latter is provided within the zone of the heel 86 with a groove 104, which is engaged by a projection 105 on sole plate 101. At its front end, the boot is provided with a recess 106, which is engaged by a locking bolt 107. The latter is slidably guided in a recess 108 in sole 100 in the longitudinal direction of the boot. Locking bolt 107 is pressed or forced into recess 106 in sole plate 101 by a pressure spring 109. Cable 78*a* of the cable set 78, which are Bowden wires, engages with locking bolt 107.

By actuating central operating device 74, locking bolt 107 is retracted by the distance "e" against the force of spring 109, which permits removal of ski boot 70 from sole plate 101, which remains retained on the ski by the binding.

Instead of one through-extending sole plate 101 it is possible, of course, to separate connection parts, which are detachably secured on the ski boot in the front and rear and retained on the ski by the binding.

In all embodiments according to FIGS. 9 to 21, an electric driving unit as the one described in the embodiment of FIGS. 6 to 8 may be used instead of hydraulic clamping or operating device 74. However, as compared to the hydraulic driving unit Z, such an electric driving unit Z' has the drawback that it requires a power source, in the form of a battery, which has to be replaced or recharged periodically.

Also, instead of the afore-described hydraulic driving devices 3 and 74, a pneumatic drive can be used, which, however, has the drawback—as compared to the hydraulic drive—that more energy is required for generating a certain pressure in the pressure medium.

Finally, it is to be noted that cable sets 5 and 6, and 7 and 8 of the embodiments according to FIGS. 1 to 8 may be provided in the form of Bowden wires as well.

The common feature of all the embodiments shown herein is that they have a central driving unit Z or Z', which is mechanically connected, that is, by means of cable sets 5 and 6, or 7 and 8, or 77 and 78, or by means of a connecting rod 95, with an element whose position is to be changed for whatever purpose is desired. As shown, such an element that is capable of changing its position may be arranged within the boot or on the boot, or it may be a part of the shaft of the boot.

While a number of embodiments of the present invention have been shown and described, it will be obvious that many changes and modifications may be made thereunto without departing from the spirit and scope of the invention.

What is claimed is:

1. A ski boot having at least one element whose relative position is to be changed, and an operating device connected to and driving such element and being provided with at least one actuating element adapted to be operated from the outside of the ski boot, the improvement comprising:

said operating device being mounted on the ski boot and consisting of a central driving unit which includes together therewith an adjusting element whose position is adjustable by the manipulation of the actuating element forming part of said driving unit, said adjusting element being connected to the element whose relative position is to be changed by means of a mechanical coupling arrangement.

2. The ski boot according to claim 1, wherein said central driving unit is mounted on the back side of said ski boot preferably on a rear shaft part capable of pivoting rearwardly.

3. The ski boot according to claim 1, wherein said mechanical coupling arrangement has at least one oblong, flexible connecting element.

4. The ski boot according to claim 3, wherein said flexible connecting element is a connecting cable.

5. The ski boot according to claim 4, wherein said connecting cable is in the form of Bowden wires.

6. The ski boot according to claim 1, wherein said mechanical coupling arrangement is formed by a connecting rod.

7. The ski boot according to claim 1, wherein said actuating element has a pan-shaped operating key on its top side.

8. The ski boot according to claim 1, wherein said operating device comprises a hydraulic operating device wherein the central driving unit includes:

a pump drivable by said actuating element, a reservoir for the hydraulic medium connected to said pump, and said adjusting element, the position of said adjusting element being adjustable by means of the pressure generated in the hydraulic medium by said pump.

9. The ski boot according to claim 8, wherein a second actuating element is provided for loosening said adjusting element.

10. The ski boot according to claim 8, wherein said actuating element serves to loosen said adjusting element.

11. The ski boot according to claim 9, which further comprises a block having a clamping cylinder bore and a pump cylinder bore as well as suction and pressure line bores with check valves enclosed therein, whereby provision is made for a pump piston at the end of the first actuating element and the second actuating element has a valve tappet for opening a relief valve.

12. The ski boot according to claim 11, wherein the adjusting element is designed as an acting piston and is guided in said clamping cylinder bore.

13. The ski boot according to claim 8, wherein said reservoir has a wall having the elasticity of rubber.

14. The ski boot according to claim 1, wherein said operating device is an electric operating device, and wherein the central driving unit has a geared motor with a downwardly directed drive shaft supporting a threaded spindle, the threaded spindle engaging the adjusting element which is designed as a clamping element.

15. The ski boot according to claim 14, wherein said geared motor is electrically connected to a battery mounted in the sole of the ski boot.

16. The ski boot according to claim 14, wherein two operating keys are mounted on the top side of the driving unit for switching the geared motor on and off with the one or other sense of rotation.

17. The ski boot according to claim 14, wherein said threaded spindle is connected to a rotary knob for driving said spindle by hand.

18. The ski boot according to claim 1, wherein said adjusting element is connected by means of the coupling arrangement with a retaining part mounted in the interior of the boot for the purpose of acting on the instep.

19. The ski boot according to claim 1, wherein said adjusting element is connected by means of the coupling arrangement with a part of at least one locking buckle.

20. The ski boot according to claim 1, having a lower shell part and a rear shaft part pivotally mounted on said shell part by means of two oppositely arranged pivot pins, wherein said adjusting element is connected with the pivot pin shank of one pivot pin by means of said coupling arrangement.

21. The ski boot according to claim 1, having a lower shell part and a tongue part secured thereon, the latter being elastically deflectable in the longitudinal direction of the boot, wherein said adjusting element is connected by means of the coupling arrangement with a limiting element capable of position change and serving to adjustably limit the motion of deflection of the tongue part.

22. The ski boot according to claim 6, having a lower shell part and a rear shaft part pivotally mounted thereon, wherein said central driving unit is secured on the rear shaft part and said connecting rod, which is adapted to retract and extend, is anchored on said shell part.

23. The ski boot according to claim 1, wherein said adjusting element is connected by means of the coupling arrangement with at least one wedge-shaped supporting element adapted to be displaced in the longitudinal direction of the boot and arranged beneath an insert sole disposed in the interior of the ski boot.

24. The ski boot according to claim 1, wherein said adjusting element is connected by means of the coupling arrangement with at least one locking element displaceably guided in the sole of the boot which cooperates with a removable sole plate for arresting said sole plate.

25. The ski boot according to claim 1, wherein said operating device comprises a pneumatic operating device.

* * * * *